US009796526B2

(12) United States Patent
Smith et al.

(10) Patent No.: US 9,796,526 B2
(45) Date of Patent: Oct. 24, 2017

(54) RECEPTACLE FOR SECURE COLLECTION OF WASTE

(71) Applicant: Call2Recycle, Inc., Atlanta, GA (US)

(72) Inventors: Carl E. Smith, Atlanta, GA (US); Leon Raudys, Atlanta, GA (US); Roxane Peggs, Atlanta, GA (US); Jonathan Belfort, Cape Elizabeth, ME (US); Oivind Brockmeier, Medford, MA (US); Miles Spadone, South Portland, ME (US); Gerd Schmieta, Boston, MA (US); Andrew String, Lynnfield, MA (US); Jason Olivero, Woburn, MA (US)

(73) Assignee: Call2Recycle, Inc., Atlanta, GA (US)

( * ) Notice: Subject to any disclaimer, the term of this patent is extended or adjusted under 35 U.S.C. 154(b) by 0 days.

(21) Appl. No.: 15/213,646

(22) Filed: Jul. 19, 2016

(65) Prior Publication Data

US 2017/0029209 A1 Feb. 2, 2017

Related U.S. Application Data

(60) Provisional application No. 62/197,154, filed on Jul. 27, 2015.

(51) Int. Cl.
*B65F 1/16* (2006.01)
*B65F 1/14* (2006.01)
(Continued)

(52) U.S. Cl.
CPC ..... *B65F 1/1615* (2013.01); *B65F 1/10* (2013.01); *B65F 1/1426* (2013.01);
(Continued)

(58) Field of Classification Search
CPC ..... G06F 21/32; G06F 21/36; G06F 21/629; G06F 2221/2111; G06F 3/0346;
(Continued)

(56) References Cited

U.S. PATENT DOCUMENTS 5,340,372 A 8/1994 Macedo et al.
6,045,070 A 4/2000 Davenport
(Continued)

FOREIGN PATENT DOCUMENTS

WO 2005103884 11/2005

OTHER PUBLICATIONS

Saving You Money Through Better Sharps Management, mailyoursharps.com (captured by webarchive.org on Jun. 28, 2009).
(Continued)

*Primary Examiner* — Mark Blouin
(74) *Attorney, Agent, or Firm* — Wiley Rein LLP

(57) ABSTRACT

A waste collection receptacle, for example a receptacle in compliance with Drug Enforcement Agency ("DEA") regulations concerning the disposal of controlled substances, includes a housing and a waste-collection container therein. A chute directs waste deposited through an aperture in the housing into the waste-collection container. A fill sensor monitors the fill level of the waste-collection container. When the waste-collection container reaches a fill threshold, a controller sends a signal that electronically locks the aperture, thereby preventing additional waste from being deposited into the receptacle.

20 Claims, 4 Drawing Sheets

(51) Int. Cl.
*G07C 9/00* (2006.01)
*B65F 1/10* (2006.01)

(52) U.S. Cl.
CPC .... *G07C 9/00896* (2013.01); *B65F 2210/148* (2013.01); *B65F 2210/1443* (2013.01); *B65F 2240/145* (2013.01)

(58) Field of Classification Search
CPC ..... G06F 21/31; G06F 21/35; G06F 21/88; G06F 3/017
USPC ..... 340/5.1
See application file for complete search history.

(56) References Cited

U.S. PATENT DOCUMENTS

| | | | | |
|---|---|---|---|---|
| 7,035,856 | B1 | 4/2006 | Morimoto | |
| 7,162,434 | B1 | 1/2007 | Walker et al. | |
| 7,562,025 | B2 * | 7/2009 | Mallett | B07C 7/005 206/366 |
| 7,881,965 | B2 | 2/2011 | Bowles et al. | |
| 8,100,989 | B2 | 1/2012 | Kunik et al. | |
| 8,195,511 | B2 | 6/2012 | Bowles et al. | |
| 8,768,858 | B1 | 7/2014 | Begen | |
| 8,813,986 | B2 * | 8/2014 | Liscio | B65F 1/10 206/366 |
| 2004/0212833 | A1 | 10/2004 | Taskett et al. | |
| 2005/0065640 | A1 | 3/2005 | Mallett et al. | |
| 2005/0080520 | A1 | 4/2005 | Kline et al. | |
| 2005/0228682 | A1 | 10/2005 | Firestone, III | |
| 2009/0004051 | A1 | 1/2009 | Firestone et al. | |
| 2009/0043253 | A1 | 2/2009 | Podaima | |
| 2012/0004761 | A1 | 1/2012 | Madruga | |
| 2015/0152348 | A1 | 6/2015 | Tusa et al. | |

OTHER PUBLICATIONS www.skinauthority.com/FREE-Shipping (captured by webarchive.org on Jul. 11, 2011).
Drug Enforcement Agency, Disposal of Controlled Substances—Proposed Rule, Fed. Reg. vol. 77, 75784-75817, Dec. 21, 2012.
Drug Enforcement Agency, Disposal of Controlled Substances—Final Rule, Fed. Reg. vol. 79, 53520-53570, Sep. 9, 2014.
RCA orientation manual (2014) (Medical Waste Regulations Chapter).

* cited by examiner

RECEPTACLE FOR SECURE COLLECTION OF WASTE

CROSS-REFERENCE TO RELATED APPLICATIONS

This application claims the benefit of U.S. provisional application No. 62/197,154, filed 27 Jul. 2015, which is hereby incorporated by reference as though fully set forth herein.

BACKGROUND

The instant disclosure relates to the collection and disposal of waste. In particular, the instant disclosure relates to a receptacle for the secure collection and disposal of controlled and non-controlled substances, such as pharmaceuticals and over-the-counter medications.

Under the Secure and Responsible Drug Disposal Act of 2010 (the "Disposal Act"), ultimate users are allowed to deliver their pharmaceutical controlled substances to others for disposal pursuant to implementing regulations promulgated by the Drug Enforcement Agency ("DEA"). See Disposal of Controlled Substances, 79 Fed. Reg. 53520 (Sep. 9, 2014), which is hereby incorporated by reference as though fully set forth herein.

These DEA regulations permit, inter alia, the use of collection receptacles for the disposal of controlled substances. They also prescribe certain characteristics of such receptacles. The regulations do not, however, fully address the potential for such receptacles to overflow, thereby subjecting consumers and collectors to the risk of potentially harmful substances and/or medical waste. The regulations also do not address the impact of the Health Insurance Portability and Accountability Act ("HIPPA") in regards to the confidentiality of healthcare information.

Nor do extant receptacles address this potential problem. Indeed, in extant receptacles, one can only determine that the receptacle is full by either a visual inspection of the receptacle's contents or by accidentally discovering that the receptacle is full upon attempting to deposit more waste therein.

BRIEF SUMMARY

Disclosed herein is a waste collection receptacle. The waste collection receptacle includes a housing defining a waste-collection chamber and including: an access port, including a door, through which waste can be deposited; and a chute leading from the access port to the waste-collection chamber. The waste collection receptacle also includes a fill sensor configured to measure a fill level of a waste-collection container positioned within the waste-collection chamber; a lock configured to secure the door of the access port against opening; and a controller in communication with the fill sensor and the lock. The controller is configured to: receive a fill level signal from the fill sensor; and send a lock command to the lock responsive to the fill level signal, wherein the lock command causes the lock to engage such that the door of the access port is secured against opening. In aspects of the disclosure, the controller is configured to send the lock command when the fill level signal indicates that the fill level of the waste-collection container exceeds a preset fill level threshold. In additional aspects of the disclosure, the controller is further configured to send an unlock command to the lock responsive to the fill level signal, wherein the unlock command causes the lock to disengage such that the door of the access port is no longer secured against opening, and wherein the controller is configured to send the unlock command when the fill level signal indicates that the fill level of the waste-collection container has fallen below the preset fill level threshold.

The fill sensor can include an optical sensor and/or an ultrasound sensor. The lock can include a solenoid bolt lock; the lock command can cause the solenoid bolt to deploy. A manual override can also be provided for the lock. It is contemplated that the door can be on an exterior of the housing.

In embodiments disclosed herein, the controller can further be configured to broadcast a fill alert when the fill level signal indicates that the fill level of the waste-collection container exceeds a preset fill level threshold. The fill alert can include one or more of an e-mail, a text message, a visual alert, and an audible alert.

According to another embodiment of the disclosure, a waste collection receptacle includes: a housing defining a waste-collection chamber, the housing including: a chute door on an exterior of the housing; and a chute leading from the chute door to the waste-collection chamber; a chute door switch operable to detect opening and closing of the chute door; a fill sensor within the housing and oriented to measure a fill level of a waste-collection container positioned within the waste-collection chamber; a lock configured to secure the chute door against opening; and a controller in communication with the chute door switch, the fill sensor, and the lock, wherein the controller is configured: to receive a signal from the chute door switch when the chute door switch detects that the chute door has opened and closed; upon receiving the signal from the chute door switch, to command the fill sensor to measure the fill level of the waste-collection container and to receive the measured fill level from the fill sensor; to compare the received measured fill level to at least one preset fill level threshold; and to set a state of the waste collection receptacle based upon the comparison of the received measured fill level to the at least one preset fill level threshold.

The at least one preset fill level threshold can include a preset near full threshold, and the controller can be configured to set a near full state when the received measured fill level exceeds the preset near full threshold.

The at least one preset fill level threshold can include a preset full threshold, and the controller can be configured to set a full state when the received measured fill level exceeds the preset full threshold. The full state setting can include sending a lock command to the lock, thereby causing the lock to engage such that the chute door is secured against opening.

According to aspects of the disclosure, the receptacle can include a service door on an exterior of the housing adjacent the waste-collection chamber; and a service door switch operable to detect opening and closing of the service door. The controller can be in communication with the service door switch and can further be configured: to receive a signal from the service door switch when the service door switch detects that the service door has opened and closed; upon receiving the signal from the service door switch, to command the fill sensor to measure the fill level of the waste-collection container and to receive the measured fill level from the fill sensor; to compare the received measured fill level to the at least one preset fill level threshold; and to set a normal state of the waste collection receptacle if the measured fill level does not exceed the at least one preset fill level threshold. The normal state setting can include sending an unlock command to the lock, thereby causing the lock to disengage such that the chute door is no longer secured against opening.

Also disclosed herein is a method of securely collecting waste using a waste collection receptacle including a locking waste collection door. The method can include the steps of: electronically measuring a fill level of a waste-collection container within the waste collection receptacle; comparing the fill level of the waste-collection container to a preset full threshold; and electronically locking the waste collection door when the fill level of the waste-collection container exceeds the preset full threshold. The method can also include electronically unlocking the waste collection door when the fill level of the waste-collection container drops below the preset full threshold.

Additionally, the method can include providing a full state alert when the fill level of the waste-collection container exceeds the preset full threshold. The full state alert can include one or more of an e-mail alert, a text message alert, a visual alert, and an audible alert.

The foregoing and other aspects, features, details, utilities, and advantages of the present invention will be apparent from reading the following description and claims, and from reviewing the accompanying drawings.

DETAILED DESCRIPTION

The present disclosure provides receptacles for the secure collection and disposal of waste. For purposes of illustration, the teachings herein will be explained with reference to a receptacle for the secure collection and disposal of controlled substances, such as used pharmaceuticals. It should be understood, however, that the instant teachings can likewise be practiced to good advantage in other contexts without departing from the spirit and scope of the present disclosure.

Figure 1:
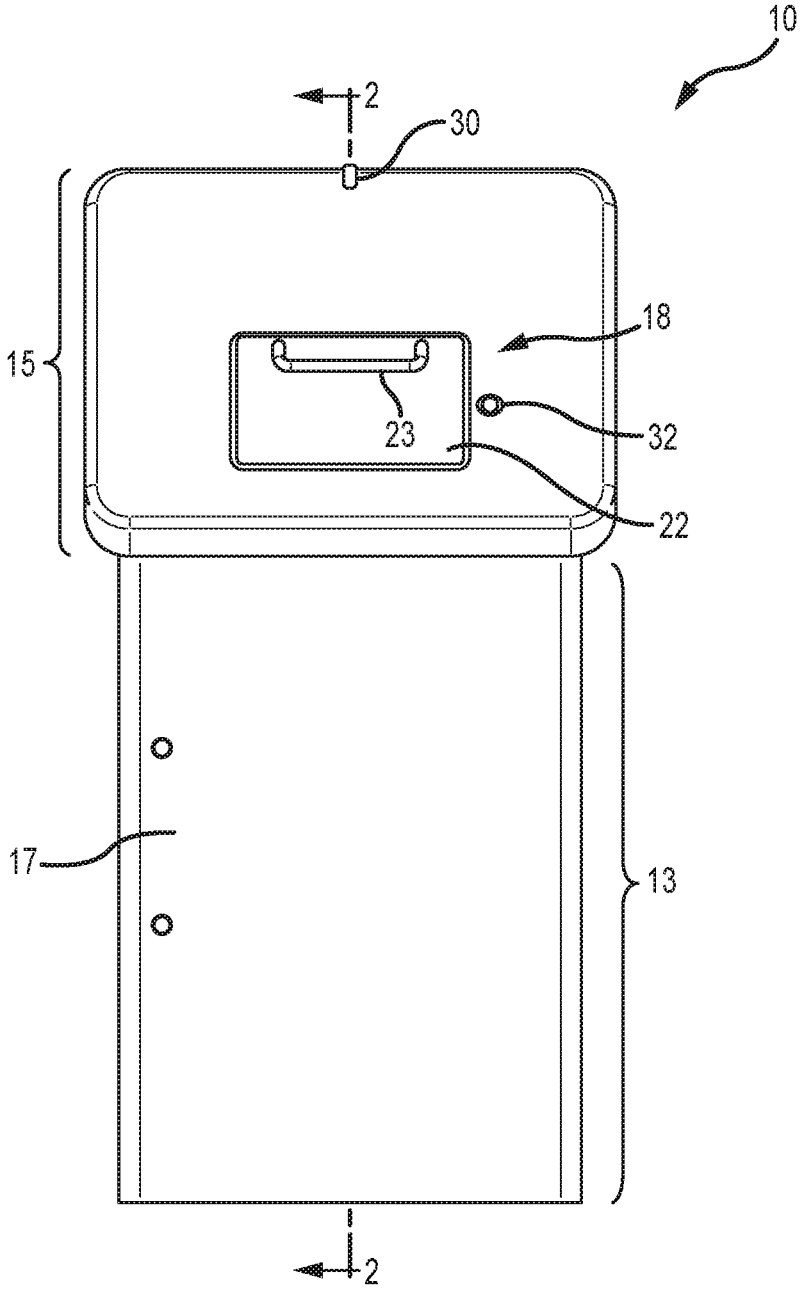
FIG. 1 is a front view of a waste collection receptacle according to aspects of the instant disclosure.
Figure 2:
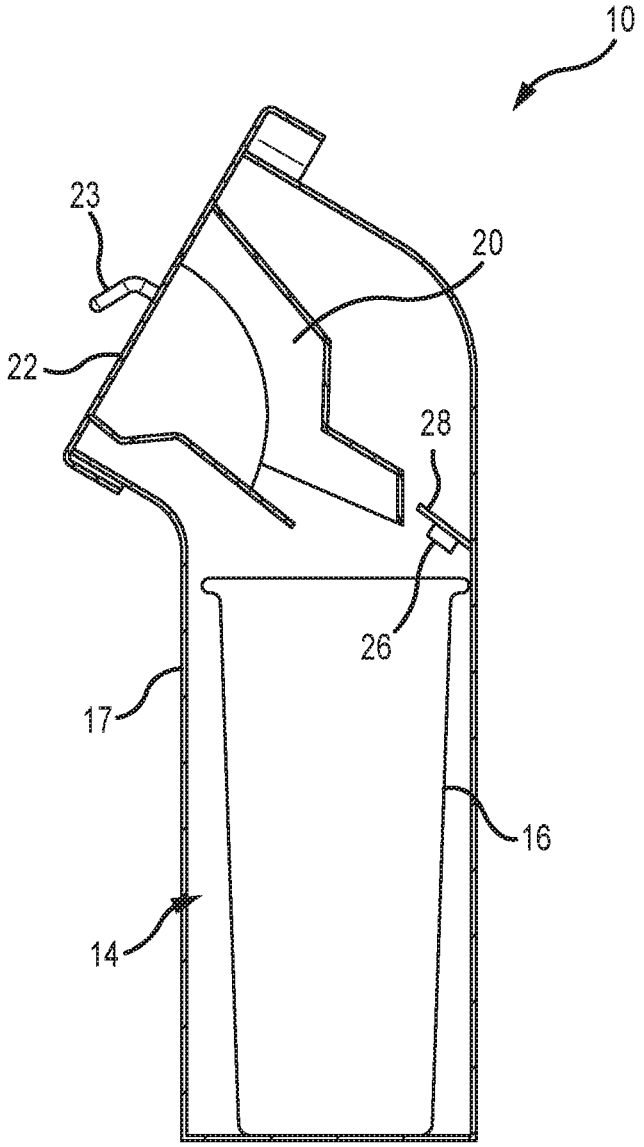
FIG. 2 is a sectional view taken along line 2-2 in FIG. 1.

FIG. 1 depicts a waste collection receptacle 10 according to a representative embodiment disclosed herein. As shown in FIG. 1, waste collection receptacle 10 generally includes a housing 12 having a lower portion 13, which defines a waste-collection chamber 14 as shown in FIG. 2, and an upper portion 15, which is shown in additional detail in FIG. 3.

A waste-collection container 16 can be placed within waste-collection chamber 14. Embodiments of the disclosure provide methods and systems for measuring the fill level of waste-collection container 16. A service door 17 provides access to waste-collection chamber 14, for example to remove and replace waste-collection container 16 when it is filled. As described in greater detail below, a switch 36 (shown in FIG. 3), such as a snap action switch, can detect when service door 17 is opened and closed.

As shown in FIG. 1, upper portion 15 of housing 12 includes an access port 18 through which waste (e.g., used pharmaceuticals and/or other controlled substances) can be deposited. When waste is so deposited, chute 20 (shown in FIG. 2) directs the waste into waste-collection container 16. A chute door 22, which can include a handle 23 for ease of use, covers access port 18. As described in greater detail below, a switch 34 (shown in FIG. 3), such as a snap action switch, can detect when chute door 22 is opened and closed.

Waste collection receptacle 10 can comply with Drug Enforcement Agency ("DEA") regulations concerning the disposal of controlled substances. For example, housing 12 can be designed to comply with 21 C.F.R. § 1317.75. Likewise, waste-collection container 16 can be designed in compliance with 21 C.F.R. § 1317.60. These regulations are incorporated by reference as though fully set forth herein.

Figure 3:
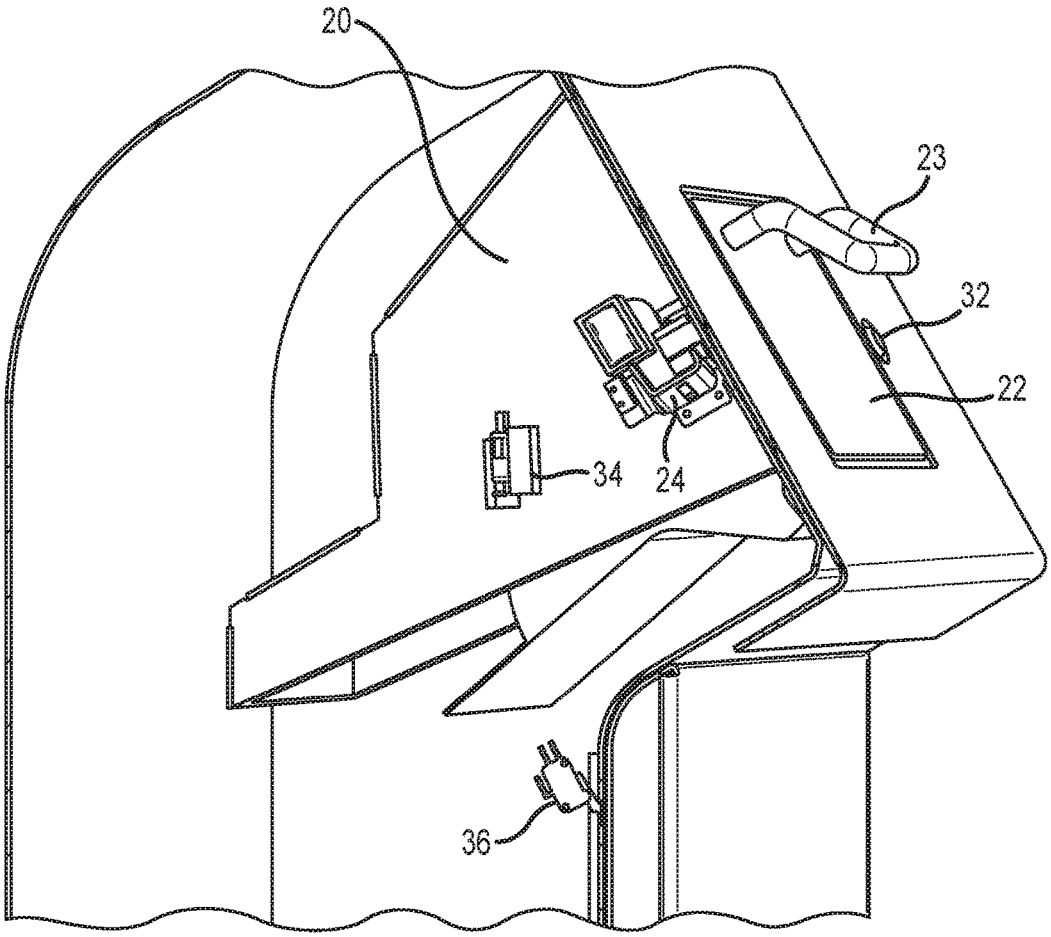
FIG. 3 illustrates details of the interior of the waste collection receptacle shown in FIG. 1.

Consistent with the foregoing DEA regulations, and as shown in FIG. 3, waste collection receptacle 10 can include a lock 24 to secure chute door 22 against opening. In embodiments, lock 24 can be a solenoid bolt lock (that is, an electromechanical locking device wherein a solenoid is used to throw the bolt). Those of ordinary skill in the art will appreciate from this disclosure that such a lock can be designed to fail safe (i.e., the bolt is open/unlocked upon power loss) or to fail secure (i.e., the bolt is closed/locked upon power loss).

In additional embodiments of the disclosure, lock 24 can utilize a latching solenoid, which allows it to remain in either the locked position or the unlocked position without power. An advantage of a latching solenoid is that it reduces the power demand of waste collection receptacle 10, as there is no requirement for constant power to keep a latching solenoid open or closed. Instead, power is only required to transition a latching solenoid between its open and closed states.

As shown schematically in FIG. 2, waste collection receptacle 10 also includes a fill sensor 26. Fill sensor 26 is configured and oriented within waste collection receptacle 10 to measure a fill level of waste accumulating in waste-collection container 16. According to aspects of the instant disclosure, fill sensor 26 can be an optical sensor. According to other aspects of the instant disclosure, fill sensor 26 can be an ultrasound sensor. The use of multiple fill sensors 26, which can all be of the same type or of multiple different types, is also contemplated.

A controller 28, shown schematically as part of a printed circuit board in FIG. 2, is in communication with both fill sensor 26 and lock 24, and can also be in communication with switches 34, 36. As shown in FIG. 2, fill sensor 26 can be on the same board as controller 28, and controller 28 can be externally interfaced, either by wire or wirelessly, with more distant components (e.g., lock 24, light 30, switches 34, 36, and/or a power supply).

Controller 28 receives a fill level signal from fill sensor 26. When the fill level signal indicates that the fill level of waste-collection container 16 exceeds a preset fill level threshold, controller 28 can send a signal to lock 24 that throws the bolt (e.g., by applying a current to lock 24 designed to fail safe, by removing a current to lock 24 designed to fail secure, or by supplying a state-change current to a latching lock 24), thereby securing chute door 22 against opening and preventing additional waste from being deposited into waste collection receptacle 10.

It is desirable, therefore, that fill sensor 26 and controller 28 be designed to interoperate in a manner that ensures the lock signal is only sent to lock 24 when the actual fill level of waste-collection container 16 exceeds the preset fill level threshold. Thus, for example, transient fill signals, such as those that might occur as waste passes along chute 20, can be ignored (e.g., by imposing a "waiting period" following the closure of chute door 22, as detected by switch 34, prior to measuring the fill level of waste-collection container 16; according to embodiments of the disclosure, the waiting period can be about 3 seconds) and/or smoothed in a manner such that only the "steady state" fill signal is analyzed for purposes of determining whether or not to send the lock signal from controller 28 to lock 24.

It is also contemplated that controller 28 can broadcast a fill alert when the fill level of waste-collection container 16 exceeds the preset fill level threshold. For example, a light 30 (e.g., a light emitting diode) on waste collection receptacle 10 can illuminate when the fill level of waste-collection container 16 exceeds the preset fill level threshold. As another example, an audible alert tone can sound when the fill level of waste-collection container 16 exceeds the preset fill level threshold. As still another example, a text message, email, audio message, or the like can be sent to a party responsible for emptying waste collection receptacle 10 when the fill level of waste-collection container 16 exceeds the preset fill level threshold. Of course, combinations of the foregoing are also contemplated.

Various aspects allow chute door 22 to be unlocked once controller 28 sends the lock signal thereto. In some embodiments, for example, a manual override is provided. The manual override can take the form of a keyhole 32; when an authorized individual uses a matching key within keyhole 32, the bolt of lock 24 can be withdrawn.

In other embodiments, controller 28 can be further configured to effect the unlocking of chute door 22. For example, when fill sensor 26 detects that the fill level of waste-collection container 16 has returned below the preset fill level threshold (for example, because an authorized individual has removed the full waste-collection container 16 for processing and replaced it with an empty waste-collection container 16), an unlock signal can be sent to lock 24 that causes the bolt to withdraw (e.g., by applying a current where lock 24 is designed to fail secure, by removing a current where lock 24 is designed to failsafe, or by supplying a state-change current to a latching lock 24), thereby releasing chute door 22 and allowing additional waste to be deposited within waste collection receptacle 10.

Waste collection receptacle 10 can also include a suitable power supply (not shown) to power the various components described above. For example, one or more batteries can be installed within waste collection receptacle 10 to power the various components thereof as described herein. Alternatively, waste collection receptacle 10 can be configured for attachment to mains electricity. In still other embodiments, waste collection receptacle 10 can be configured for attachment to mains electricity, with one or more batteries provided for backup in the event of a mains electricity outage.

Figure 4:
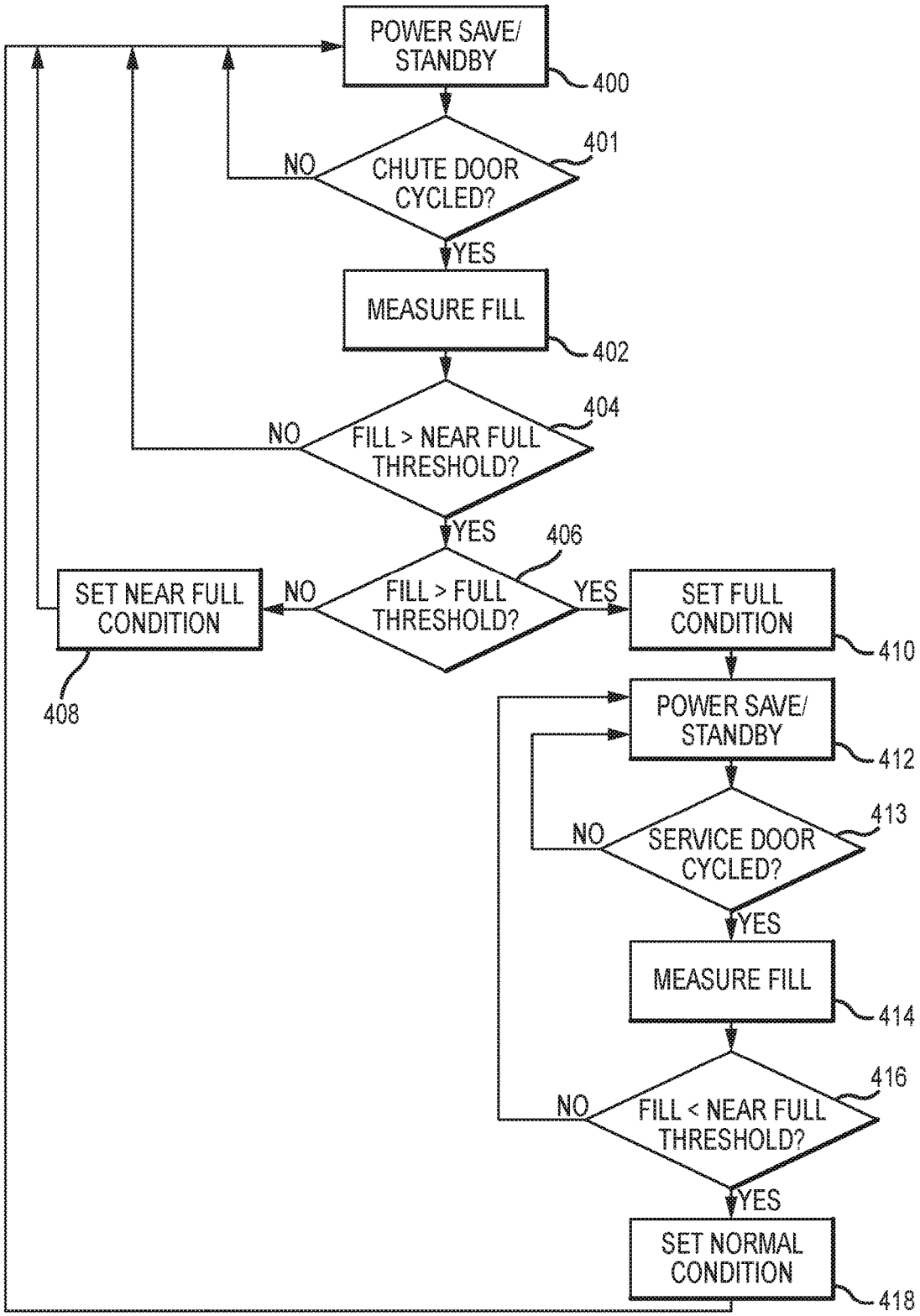
FIG. 4 is a flowchart of representative steps that can be carried out to collect waste securely, for example using the waste collection receptacle of FIG. 1.

One method of operation of waste collection receptacle 10 will be described with reference to the representative steps shown in the flow diagram of FIG. 4. To conserve power, controller 28 generally waits in a first power save or standby state 400. Within power save state 400, controller 28 monitors (decision block 401) for switch 34 to be tripped by the opening and closing of chute door 22 (e.g., to deposit waste into chute 20).

When switch 34 is tripped (e.g., by the open-closed cycling of chute door 22), controller 28 moves into a measure state 402. In measure state 402, controller 28 commands fill sensor 26 to measure the level of waste-collection container 16 and then receives the fill measurement from fill sensor 26. In decision block 404, controller 28 compares the fill measurement from fill sensor 26 to a preset fill threshold that defines a near full state of waste-collection container 16. This is referred to herein as the "near full threshold." According to embodiments of the instant disclosure, the near full threshold can be 80% full. If the fill measurement does not exceed the near full threshold, then controller 28 returns to first power save/standby state 400 and waits for switch 34 to be tripped the next time chute door 22 is cycled.

If the fill measurement exceeds the near full threshold, controller 28 compares (decision block 406) the fill measurement to a preset fill threshold that defines a completely full state of waste-collection container 16. This is referred to herein as the "full threshold." According to embodiments of the instant disclosure, the full threshold can be 95% full.

If the fill measurement exceeds the near full threshold, but does not exceed the full threshold, then controller 28 sets a near full condition in block 408. This can include, for example, one or more of: illuminating light 30 in a color that indicates the near full state of waste-collection container 16; sounding an audible alert that indicates the near full state of waste-collection container 16; sending a text, email, or other message to a responsible party regarding the near full state of waste-collection container 16; or the like. Once the near full condition is set, controller 28 returns to first power save/standby state 400 and waits for switch 34 to be tripped the next time chute door 22 is cycled.

If the full measurement exceeds the full threshold, then controller 28 sets a full condition in block 410. As part of setting the full condition, controller 28 sends the lock signal from to lock 24, thereby locking chute door 22 and preventing more waste from being deposited into waste collection receptacle 10. It can also include, for example, one or more of: illuminating light 30 in a color that indicates the full state of waste-collection container 16; sounding an audible alert that indicates the full state of waste-collection container 16; sending a text, email, or other message to a responsible party regarding the full state of waste collection container 16; or the like.

Once the full condition is set, controller 28 moves to a second power save/standby state 412. In second power save/standby state 412, controller 28 monitors (block 413) for cycling (e.g., opening and closing) of service door 17 (e.g., as would be associated with removal and replacement of a full waste-collection container 16), as detected by switch 36.

When service door 17 is cycled, as detected by switch 36, controller 28 moves into a measure state 414. In measure state 414, like measure state 402, controller 28 commands fill sensor 26 to measure the level of waste-collection container 16 and receives the fill measurement therefrom.

In block 416, the fill level as measured in block 414 is compared to the near full threshold. If the fill has not dropped below the near full threshold (e.g., because the full waste-collection container 16 has not been replaced), then controller 28 returns to second power save/standby state 412, and chute door 22 remains locked.

If the fill has dropped below the near full threshold (e.g., due to removal of a full waste-collection container 16 and replacement with an empty waste-collection container 16), then controller 16 will set a normal condition in block 418. In the normal condition, controller 28 sends the unlock signal to lock 24, unlocking chute door 22 and readying waste collection receptacle 10 for additional use. Controller 28 can also cease any alerts or signals associated with the full condition (e.g., turning off light 30; suspending any audible alarms). Controller 28 then returns to first power save/standby state 400.

Although several embodiments have been described above with a certain degree of particularity, those skilled in the art could make numerous alterations to the disclosed embodiments without departing from the spirit or scope of this invention.

For example, although chute door 22 is illustrated as being on the outside of housing 12, it could be positioned anywhere along chute 20, as long as it can be locked in a manner that prevents additional waste from passing into waste-collection container 16 when the same is full.

As another example, controller 28 can monitor for a low power state. If a low power state is detected, controller 28 can generate an alert signal (e.g., illuminating light 30 in a color or flash sequence that indicates low power; sounding a low power audible alert; sending a low power text or email message to a responsible party; or the like).

As still another example, controller 28 can monitor for error states, such as failure of lock 24 to lock or unlock correctly. If an error state is detected, controller 28 can generate a suitable alert.

As a further example, controller 28 can maintain a data log of how many times chute door 22 is opened and closed, how many times service door 17 is opened and closed, how many times waste-collection container 16 is removed and replaced, and the like.

As yet a further example, controller 28 can operate to send the lock signal to lock 24 upon detecting that service door 17 is opened, thereby preventing the deposit of waste through chute 20 with service door 17 open.

All directional references (e.g., upper, lower, upward, downward, left, right, leftward, rightward, top, bottom, above, below, vertical, horizontal, clockwise, and counterclockwise) are only used for identification purposes to aid the reader's understanding of the present invention, and do not create limitations, particularly as to the position, orientation, or use of the invention. Joinder references (e.g., attached, coupled, connected, and the like) are to be construed broadly and may include intermediate members between a connection of elements and relative movement between elements. As such, joinder references do not necessarily infer that two elements are directly connected and in fixed relation to each other.

It is intended that all matter contained in the above description or shown in the accompanying drawings shall be interpreted as illustrative only and not limiting. Changes in detail or structure may be made without departing from the spirit of the invention as defined in the appended claims.

What is claimed is:

1. A waste collection receptacle, comprising:

a housing defining a waste-collection chamber, the housing comprising:

an access port, including a door, through which waste can be deposited; and a chute leading from the access port to the waste-collection chamber;

a fill sensor configured to measure a fill level of a waste-collection container positioned within the waste-collection chamber;

a lock configured to secure the door of the access port against opening; and a controller in communication with the fill sensor and the lock and configured to:

receive a fill level signal from the fill sensor; and send a lock command to the lock responsive to the fill level signal, wherein the lock command causes the lock to engage such that the door of the access port is secured against opening.

2. The receptacle according to claim 1, wherein the controller is configured to send the lock command when the fill level signal indicates that the fill level of the waste-collection container exceeds a preset fill level threshold.

3. The receptacle according to claim 2, wherein the controller is further configured to send an unlock command to the lock responsive to the fill level signal, wherein the unlock command causes the lock to disengage such that the door of the access port is no longer secured against opening, and wherein the controller is configured to send the unlock command when the fill level signal indicates that the fill level of the waste-collection container has fallen below the preset fill level threshold.

4. The receptacle according to claim 1, wherein the fill sensor comprises an optical sensor.

5. The receptacle according to claim 1, wherein the fill sensor comprises an ultrasound sensor.

6. The receptacle according to claim 1, wherein the lock comprises a solenoid bolt lock, and wherein the lock command causes the solenoid bolt to deploy.

7. The receptacle according to claim 1, wherein the controller is further configured to broadcast a fill alert when the fill level signal indicates that the fill level of the waste-collection container exceeds a preset fill level threshold.

8. The receptacle according to claim 6, wherein the fill alert comprises one or more of an e-mail, a text message, a visual alert, and an audible alert.

9. The receptacle according to claim 1, further comprising a manual override for the lock.

10. The receptacle according to claim 1, wherein the door is on an exterior of the housing.

11. A waste collection receptacle, comprising:

a housing defining a waste-collection chamber, the housing comprising:

a chute door on an exterior of the housing; and a chute leading from the chute door to the waste-collection chamber;

a chute door switch operable to detect opening and closing of the chute door;

a fill sensor within the housing and oriented to measure a fill level of a waste-collection container positioned within the waste-collection chamber;

a lock configured to secure the chute door against opening; and a controller in communication with the chute door switch, the fill sensor, and the lock, wherein the controller is configured:

to receive a signal from the chute door switch when the chute door switch detects that the chute door has opened and closed;

upon receiving the signal from the chute door switch, to command the fill sensor to measure the fill level of the waste-collection container and to receive the measured fill level from the fill sensor;

to compare the received measured fill level to at least one preset fill level threshold; and to set a state of the waste collection receptacle based upon the comparison of the received measured fill level to the at least one preset fill level threshold.

12. The receptacle according to claim 11, wherein the at least one preset fill level threshold comprises a preset near full threshold, and wherein the controller is configured to set a near full state when the received measured fill level exceeds the preset near full threshold.

13. The receptacle according to claim 11, wherein the at least one preset fill level threshold comprises a preset full threshold, and wherein the controller is configured to set a full state when the received measured fill level exceeds the preset full threshold.

14. The receptacle according to claim 13, wherein setting the full state comprises sending a lock command to the lock, thereby causing the lock to engage such that the chute door is secured against opening.

15. The receptacle according to claim 14, further comprising:

a service door on an exterior of the housing adjacent the waste-collection chamber; and a service door switch operable to detect opening and closing of the service door, wherein the controller is in communication with the service door switch and is further configured:

to receive a signal from the service door switch when the service door switch detects that the service door has opened and closed;

upon receiving the signal from the service door switch, to command the fill sensor to measure the fill level of the waste-collection container and to receive the measured fill level from the fill sensor;

to compare the received measured fill level to the at least one preset fill level threshold; and to set a normal state of the waste collection receptacle if the measured fill level does not exceed the at least one preset fill level threshold.

16. The receptacle according to claim 15, wherein setting the normal state comprises sending an unlock command to the lock, thereby causing the lock to disengage such that the chute door is no longer secured against opening.

17. A method of securely collecting waste using a waste collection receptacle including a locking waste collection door, comprising:

electronically measuring a fill level of a waste-collection container within the waste collection receptacle;

comparing the fill level of the waste-collection container to a preset full threshold; and electronically locking the waste collection door when the fill level of the waste-collection container exceeds the preset full threshold.

18. The method according to claim 17, further comprising electronically unlocking the waste collection door when the fill level of the waste-collection container drops below the preset full threshold.

19. The method according to claim 17, further comprising providing a full state alert when the fill level of the waste-collection container exceeds the preset full threshold.

20. The method according to claim 19, wherein the full state alert comprises one or more of an e-mail alert, a text message alert, a visual alert, and an audible alert.

* * * * *